United States Patent [19]

Geist

[11] 4,129,240

[45] Dec. 12, 1978

[54] ELECTRIC NAILER

[75] Inventor: Bernard W. Geist, Melrose Park, Ill.

[73] Assignee: Duo-Fast Corporation, Franklin Park, Ill.

[21] Appl. No.: 813,080

[22] Filed: Jul. 5, 1977

[51] Int. Cl.[2] ..... B25C 1/06

[52] U.S. Cl. ..... 227/8; 227/131

[58] Field of Search ..... 227/7, 8, 79, 80, 110, 227/111, 129, 131, 133; 173/13, 124; 254/30; 83/572, 573, 627; 30/362, 366

[56] References Cited

U.S. PATENT DOCUMENTS

| | | | |
|---|---|---|---|
| 2,378,131 | 6/1945 | Dirksen et al. | 173/124 |
| 2,487,530 | 11/1949 | Dirksen | 173/124 |
| 2,500,217 | 3/1950 | Taylor, Jr. | 227/7 |
| 2,593,186 | 4/1952 | Richardson | 173/124 |
| 2,869,824 | 1/1959 | Hazak | 173/124 |
| 3,149,412 | 9/1964 | Curfman et al. | 254/30 |
| 3,376,933 | 4/1968 | Burlett | 254/30 |
| 4,042,036 | 8/1977 | Smith et al. | 227/131 |

*Primary Examiner*—Granville Y. Custer, Jr.
*Attorney, Agent, or Firm*—Mason, Kolehmainen, Rathburn & Wyss

[57] ABSTRACT

An impact tool includes a rotational energy device mounted within the housing of the tool. A driver is reciprocally mounted within the housing and is coupled to the energy device by a toggle member. The toggle member includes a clutch and is actuated to transfer energy from the energy device to the driver. The driver and toggle are driven through a power stroke upon engagement of the clutch with the energy device. Upon completion of the power stroke, the clutch engages a bumper removing the clutch from the energy device and the toggle and driver are returned by a return assembly driven by the energy device.

A second embodiment of the tool includes a wheel rotatably mounted on the toggle. The driver is positioned between the energy device and the wheel such that once the wheel is moved by the toggle, the driver engages the energy device and is driven thereby.

27 Claims, 11 Drawing Figures

FIG. 10
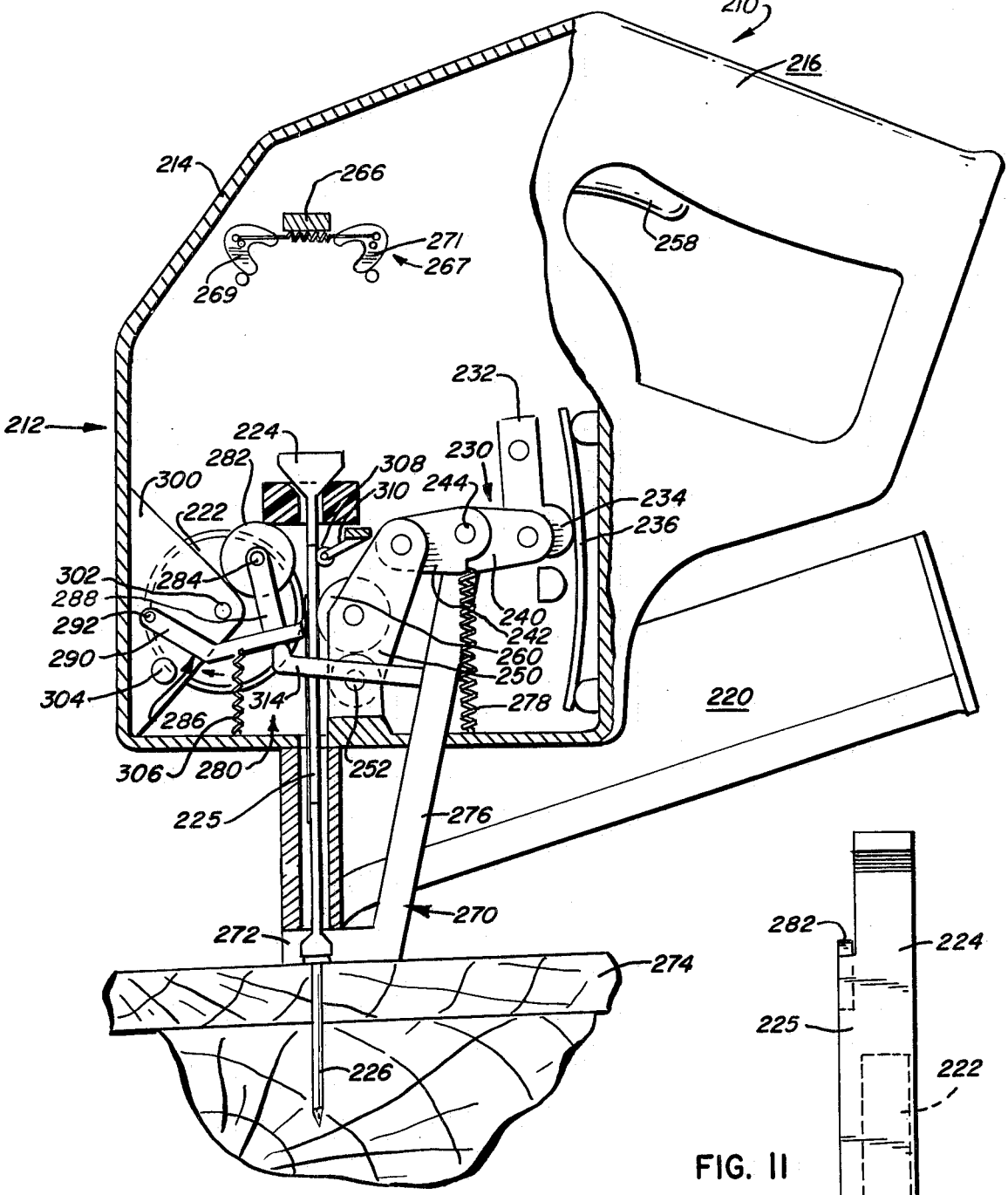
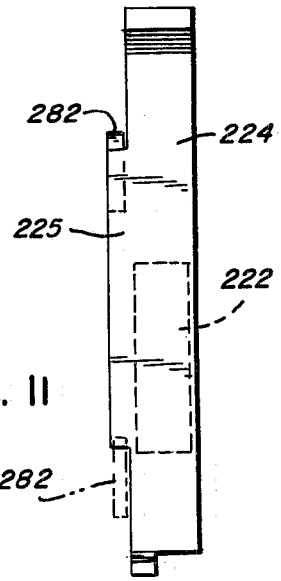
FIG. 11

ELECTRIC NAILER

BACKGROUND OF THE INVENTION

A. Field of the Invention

The present invention relates to an impact tool for driving fasteners into a workpiece.

B. Description of the Prior Art

In industries such as the construction industry, impact tools are employed to drive fasteners into a workpiece. For example, these tools may be used to drive a nail into a stud to secure wallboard. A tool of this type may be pneumatically powered. Such a tool, however, requires a source of high pressure air or similar fluid. This limits the tool's utility, since the tool may only be used within a reasonable distance of a source of pressurized air such as a compressor.

A more readily available source of power is electricity. Consequently, many impact tools are electrically operated thereby increasing their convenience to the user. In order to drive fasteners such as a nail by an electric impact tool, however, substantial impact forces are necessary.

One type of prior art electric impact tool directly couples the driver to the source of electricity. This tool does not generate sufficient driving forces for large fasteners since the necessary structure to develop a sufficient force in a short span of time is too bulky or heavy for most electric tools, particularly, portable hand-held tools.

A second type of electric tool employs one or more rotational energy devices such as a flywheel. The flywheel is constantly rotated by an electrical motor and once it is desired to power the driver through a driving stroke, the flywheel is mechanically coupled to the driver. Upon completion of the driving stroke, the flywheel is uncoupled from the driver.

This second type of tool draws energy from the flywheel for only a brief period of time allowing the flywheel to regain lost energy in preparation for the next driving stroke. In this manner, a constant source of substantial driving power is available while employing the same source of electrical energy as the first type of tool.

One disadvantage of this latter type of impact tool is that several mechanical components are necessary to couple the flywheel to the driver. An example of a tool employing elaborate structure to couple the flywheel to the driver is illustrated in U.S. Pat. No. 1,823,644.

Further, some tools use a complex structure including springs and cams mechanically operated by hand levers. An example of this type of tool is illustrated in U.S. Pat. No. 2,378,131.

A further type of tool employs two high speed rotating flywheels one of which is moved into engagement with driver capturing the driver between the two flywheels. Such a device requires two motors, one for each rotating flywheel, in addition to requiring additional mechanical structure to maintain the movable flywheel in a stable position while the driver is in a static position. Additional structure is also required to move the flywheel into engagement with the driver.

SUMMARY OF THE INVENTION

An object of the present invention is to provide a new and improved tool for driving fasteners.

Another object of the present invention is to provide a new and improved electric tool for driving a fastener with a substantial impact.

A further object of the present invention is to provide a new and improved impact tool for driving fasteners using a high energy flywheel and a toggle mechanism.

Another object of the present invention is to provide a new and improved impact tool including a return mechanism coupled to a flywheel.

Briefly, the present invention is directed to an impact tool for driving fasteners into a workpiece. The tool includes a reciprocating driver mounted in the housing of the tool and a rotatably mounted flywheel that is rotated by an electric motor. The flywheel is mechanically coupled to the driver by a toggle member.

A clutch is coupled to the toggle member, and in a first, static position of the toggle member the clutch is spaced from the flywheel. Upon actuation of the tool, the toggle is moved to a second position causing the clutch to engage the flywheel thereby transmitting the rotational energy of the flywheel to the driver to power the driver through a drive stroke. At the end of the drive stroke the clutch member engages a bumper moving the toggle to its first position causing the clutch to move away from the flywheel. A member such as a spring may then be employed to return the toggle and driver to their original positions.

In an alternate embodiment of the tool, the toggle mechanism includes a wheel rotatably mounted thereon. In a first static position of the toggle, the wheel is spaced from the driver. Upon energization of the tool, the toggle mechanism is moved to a second, energy transferring position whereupon the wheel is moved into engagement with the driver forcing the driver against the flywheel. In this position, the driver is clamped between the flywheel and the wheel on the toggle. The driver is then powered through a drive stroke.

The tool may also include a return assembly that is coupled to the flywheel. The return assembly is mounted in the housing of the tool so that it may be pivoted. Pivoting of the assembly is provided by a work engagement member that upon engagement with a workpiece pivots the assembly into engagement with the ram and the flywheel.

In this manner, the work engagement member functions to pivot the return assembly into and out of engagement with the ram in a selective manner such that the driver is returned upon removal of the engagement member from the workpiece.

BRIEF DESCRIPTION OF THE DRAWINGS

The above and other objects and advantages and novel features of the present invention will become apparent from the following detailed description of preferred embodiments of the invention illustrated in the accompanying drawings, wherein:

FIG. 10 is a view of the tool illustrated in FIG. 9 in the drive position; and

FIG. 11 is an enlarged view of the driver of the tool illustrated in FIGS. 9 and 10.

DETAILED DESCRIPTION OF THE PREFERRED EMBODIMENTS

Figure 1:
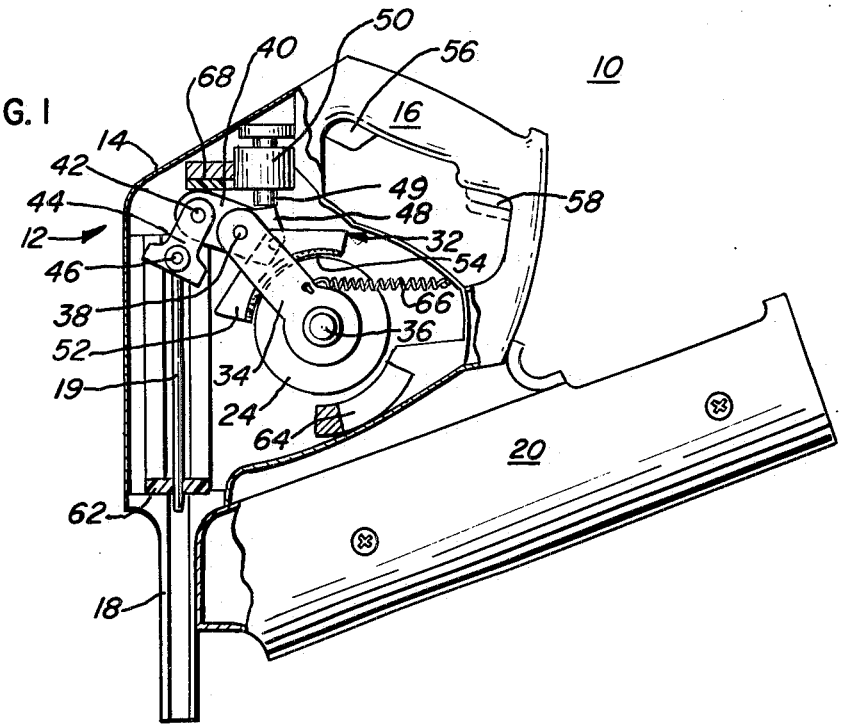
FIG. 1 is a sectional view of an impact tool in the static position constructed in accordance with the principles of the present invention.
Figure 2:
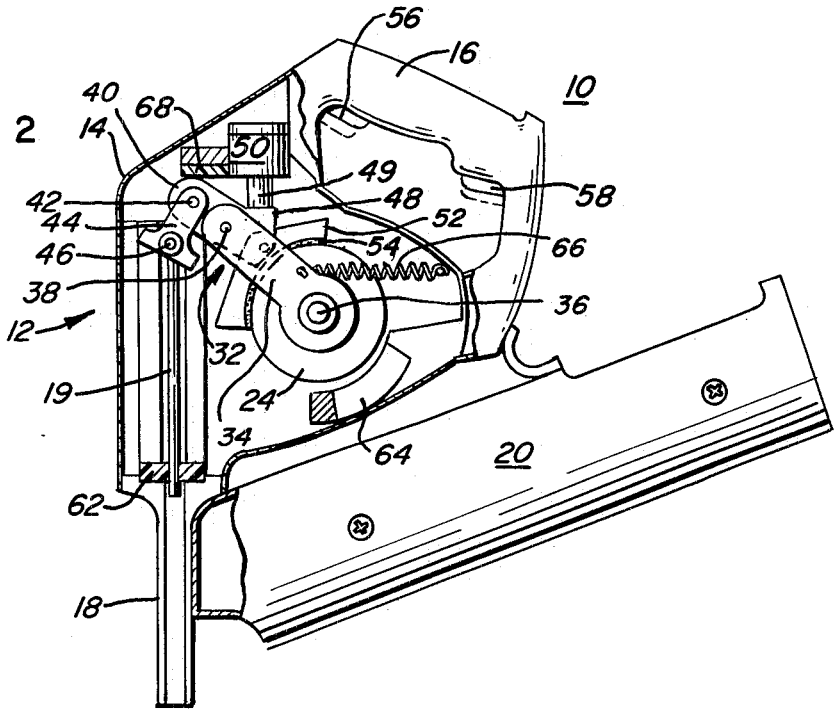
FIG. 2 is a view of the tool upon actuation.

With reference now to the figures and initially to FIGS. 1-6, there is illustrated an electric impact tool generally designated by the reference numeral 10. The impact tool 10 is of the type intended to drive fasteners, such as, for example, nails, into a workpiece. The impact tool 10 is defined by a housing 12 that includes a body 14 housing the various components of the tool 10.

Defined on the housing 12 is a handle 16 that may be grasped by the operator of the tool 10. The lower portion of the body 12 includes a nose 18 that may be placed onto a workpiece and along which the driver 19 of the tool is driven.

Releasably secured to the bottom of the housing 12 is a magazine assembly 20. The fasteners to be driven by the tool 10 are contained within the magazine assembly 20 and are individually fed to the nose portion 18 to be driven by the tool 10. The tool 10 also includes a motor 22 (FIG. 6) that is powered by a source of electric power.

To overcome the inability of prior art electric impact tools to generate sufficient power in the short time span required to drive consecutive fasteners, the tool 10 also includes a flywheel 24 rotatably mounted within the housing 12. The flywheel 24 is continuously driven by the motor 22.

The flywheel 24 includes a driven gear 26 defined thereon. The driven gear 26 meshes with a driving gear 28 that is coupled to the motor 22. In this manner, the rotation of the motor 22 is in a first direction and through the interaction of the driving 28 and driven 26 gears, the flywheel 24 is continuously rotated in an opposite direction. The offsetting rotations of the motor 22 and flywheel 24 result in offsetting precessional forces, thereby minimizing the adverse effects that may be imparted to the hand of the user of the tool 10.

To drive the individual fasteners into a workpiece, the tool 10 includes a driver 19 reciprocally mounted within the housing 12 and positioned so as to be driven through the nose portion 18. During a power stroke, the end of the driver 19 contacts a fastener positioned within the nose portion 18 driving it into a workpiece.

It is the purpose of the tool 10 to couple mechanically the power of the rotating flywheel 24 to the driver 19 for a brief span of time to drive the driver 19 through a drive stroke. Once the drive stroke has been completed, the mechanical coupling of the driver 19 to the flywheel 24 is released allowing the motor 22 to again increase the rotational speed of the flywheel 24 to the desired level thereby maintaining the flywheel 24 at a high level of energy. In this manner, the flywheel 24 may be repeatedly coupled to the driver 19 to power the driver 19 through repetitive drive strokes with the desired level of energy.

To couple the driver 19 to the flywheel 24, a coupling or toggle mechanism generally designated by the reference numeral 32 is employed. The mechanism 32 includes a pivot arm 34 that is coupled by a bearing to the shaft 36 of the flywheel 24. The pivot arm 34 is pivotally coupled by a pin 38 to a lock lever 40. The lock lever 40 is also pivotally coupled by a pin 42 to a driver guide 44. The driver guide 44 is, in turn, pivotally coupled by a guide bushing 46 to the top of the driver 19.

The pivot arm 34, the lock lever 40 and the driver guide 44 define a toggle. The joint or knee of the toggle is defined at the pin 38 where the pivot arm 34 is coupled to the lock lever 40. The lock lever 40 includes an extension 48 defining a flat surface adjacent the knee that is adapted to be engaged by the armature 49 of a solenoid 50 that is secured within the housing 12.

To couple the toggle mechanism 32 to the flywheel 24 so as to transfer energy through the toggle mechanism 34 to the driver 19, a clutch shoe 52 is pivotally secured to the lock lever 40. The clutch shoe 52 has an inner surface 54 that may include a highly frictional material that, in the driver powering position, engages the outer periphery of the flywheel 24.

To actuate the driver 19 through a driving stroke, the tool 10 includes a solenoid switch 56 and a motor switch 58 defined on the handle 16. The motor switch 58 is first actuated to energize the motor 22. Thereafter, the solenoid switch 56 may be depressed actuating the solenoid 50 and causing the armature 49 of the solenoid to engage the extension 48 of the lock lever 40. Once this occurs, the lock lever 40 and pivot arm 34 are moved through a locking angle designated as a in FIG. 6. In this position, the locking lever 40 and the pivot arm 34 lie along a radius of the flywheel 24 and the toggle 32 is in its rigid, extended position.

Figure 3:
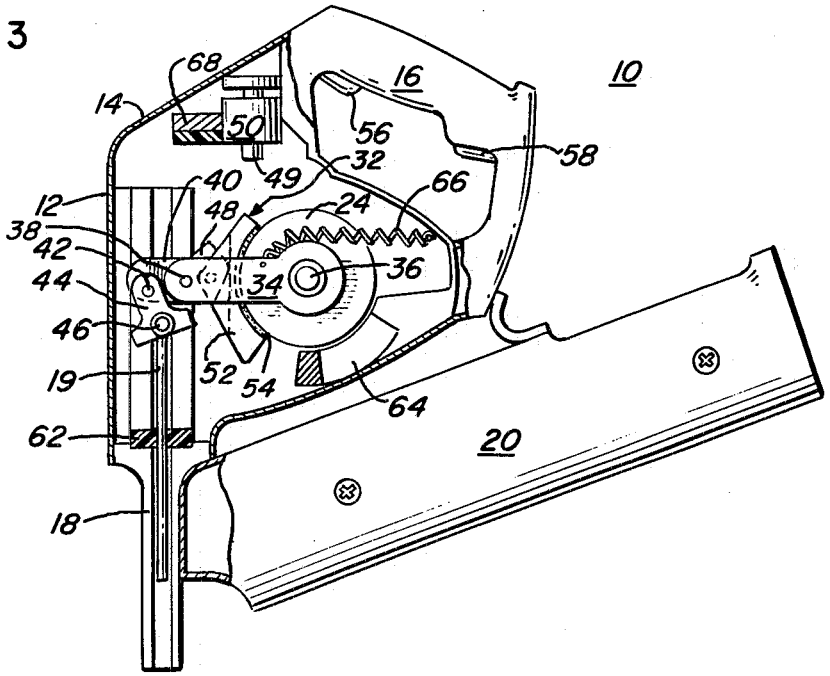
FIG. 3 is a view of the tool in the driving stroke.

This movement of the toggle mechanism 32 moves the clutch shoe 52 and specifically the inner surface 54 thereof into engagement with the outer periphery of the flywheel 24. This engagement begins the drive stroke of the driver 19. As best illustrated in FIG. 3, during the driving stroke the pivot arm 34 and the lock lever 40 are maintained along a straight line on a radius of the flywheel 24, and due to the engagement of the clutch shoe 52 with the flywheel 24, the pivot arm 34 and lock lever 40 are rotated downwardly.

Figure 4:
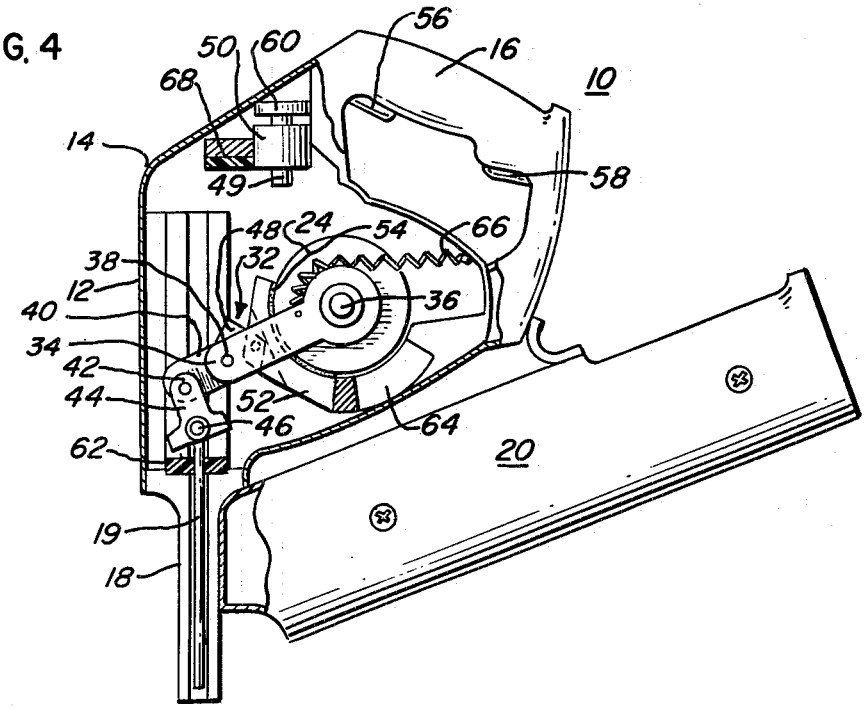
FIG. 4 is a view of the tool at the completion of the driving stroke.
Figure 5:
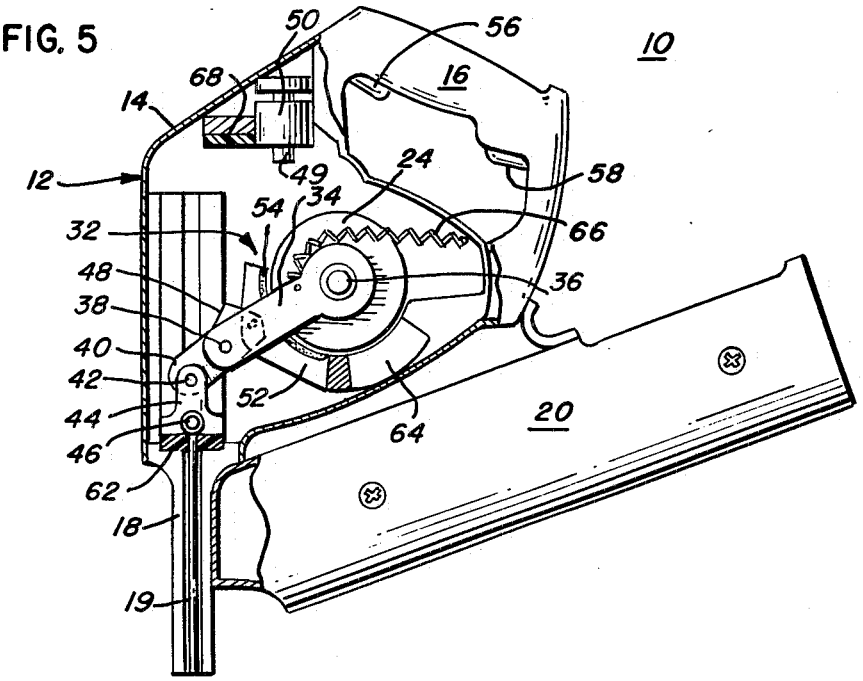
FIG. 5 is a view of the tool prior to commencement of the return of the driver.
Figure 6:
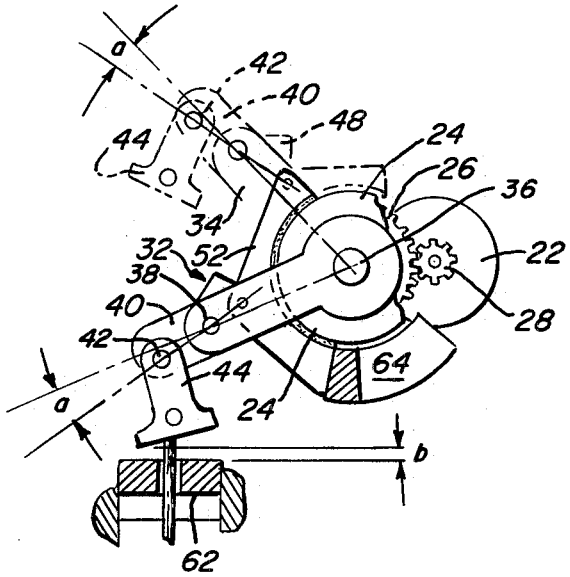
FIG. 6 is a diagrammatic illustration of the drive mechanism of the tool illustrated in FIG. 1.

The housing 12 also includes a stop bumper 62 and a release bumper 64. As illustrated in FIG. 4, upon the completion of the drive stroke of the driver 19, the clutch shoe 52 engages the release bumper 64. Upon engagement, the lock lever 40 is moved through the locking angle a to its initial position relative to the pivot arm 34 as illustrated in FIG. 1. This action moves the clutch shoe 52 out of engagement with the outer periphery of the flywheel 24 (FIG. 5). As illustrated in FIG. 6, upon engagement of the clutch shoe 52 with the release bumper 64. The driver guide 44 is spaced by a gap b from the stop bumper 62. This gap b allows release of the clutch shoe 52 from the flywheel 24 prior to engagement with the bumper.

Once the lock angle a has been increased upon engagement of the clutch shoe 52 with the release bumper 64, a spring 66 or similar return device coupled to the pivot arm 34 returns the toggle assembly 32 and the disengaged clutch shoe 52 to its original static position (FIG. 1). The spring 66 returns the toggle assembly 32 until it engages the return bumper 68 thereby terminating the return movement of the toggle assembly 32 and the driver 19 whereupon the tool is ready to be fired again by actuation of the solenoid switch 56.

Figure 7:
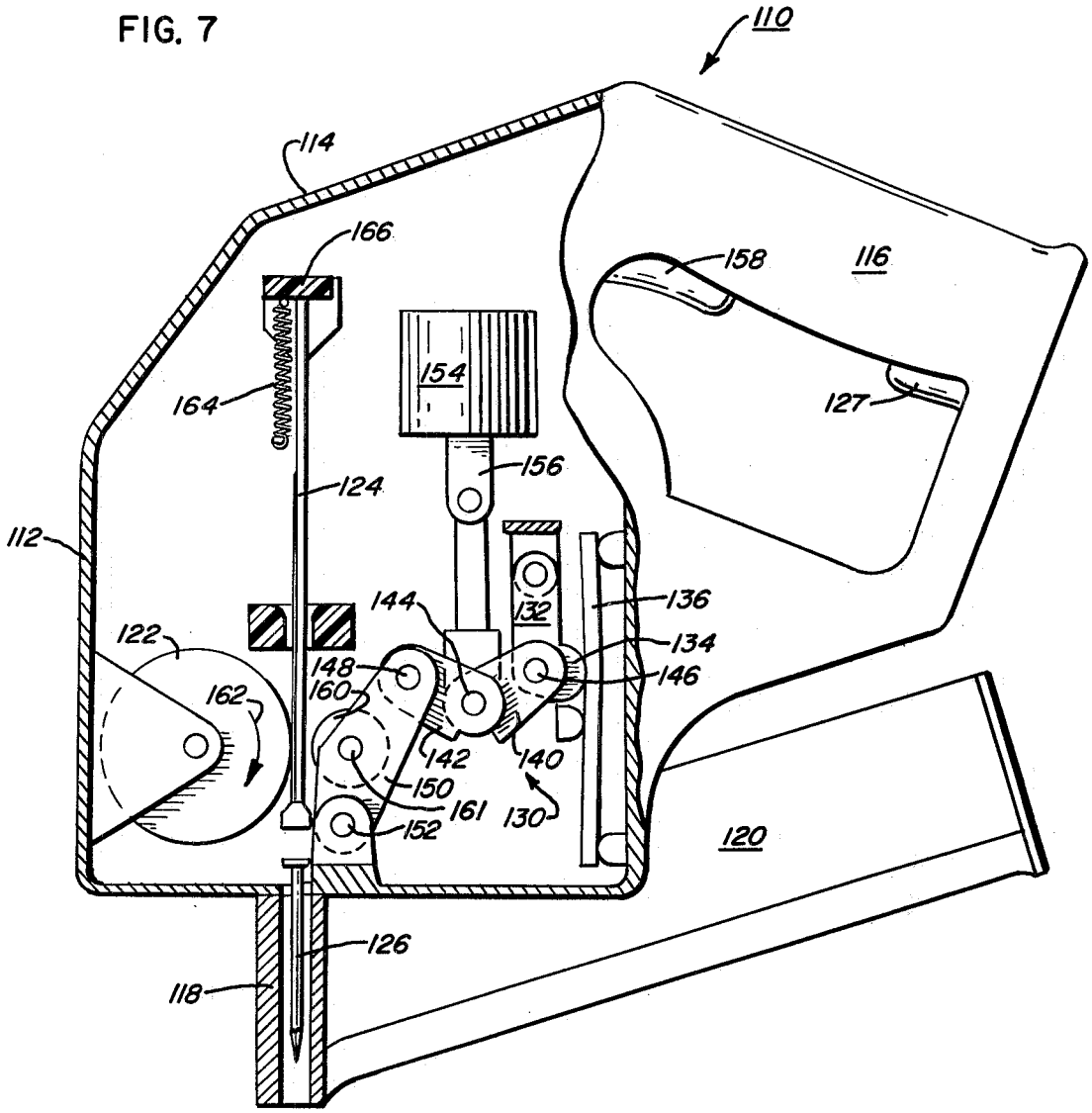
FIG. 7 is a partially cut-away view of an alternative embodiment of the tool illustrated in FIG. 1 in the static position.
Figure 8:
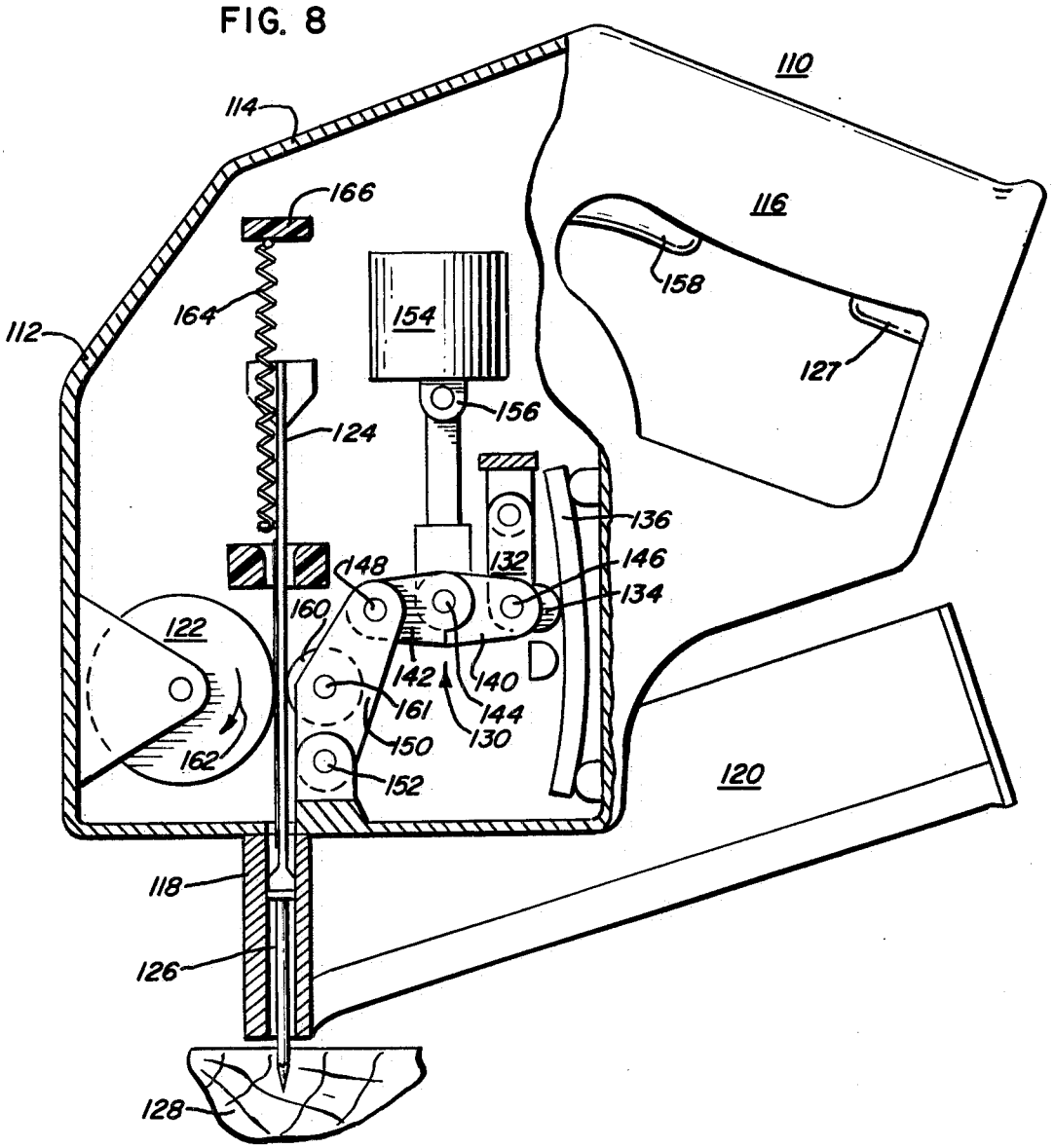
FIG. 8 is a view of the tool illustrated in FIG. 7 during the driving stroke.

Having reference now to FIGS. 7 and 8, there is illustrated an alternative embodiment 110 of the impact tool illustrated in FIGS. 1–6. The illustrated impact tool 110 is also adapted to be coupled to a source of electrical energy to power the tool. The tool 110 includes a housing 112 defining a head 114 and a handle 116 that is adapted to be grasped by the operator of the tool. Similarly, the housing 112 also defines a nose portion 118.

In a manner similar to the tool 10, the tool 110 includes a magazine assembly 120 that is secured to the housing 112. The tool 110 also includes a flywheel 122 that is driven by a motor (not shown) in a manner similar to the flywheel and motor assembly disclosed in reference to the tool 10 illustrated in FIGS. 1–6.

The tool 110 is adapted to clamp or move the driver 124 against the flywheel 122 to drive the driver through a drive or power stroke thereby driving a fastener 126 into a workpiece 128. The driver 124 may include frictional material on the surface adjacent to the flywheel 122 so that when the driver 124 is pressed or clamped against the flywheel 122, the driver 124 more securely engages the flywheel 122 and is driven thereby.

The motor upon actuation of the motor switch 127 continuously rotates the flywheel 122 at high angular velocities and the energy of the flywheel 122 is to be coupled to the driver 124. For this purpose, the drive tool 110 includes a toggle or coupling mechanism 130 for mechanically coupling the energy of the flywheel 122 to the driver 124. The toggle assembly 130 includes an arm 132 that is pivotally coupled to the housing 112 and includes a bulb portion or extension 134 that engages a beam spring 136 secured to the housing 112.

The toggle mechanism 130 includes two portions 140 and 142 that are pivotally joined by a pin 144. The first portion 140 is also pivotally coupled to the arm 132 by a pin 146. The other portion 142 is pivotally connected by a pin 148 to an idler pivot arm 150. The idler pivot arm 150, in turn, is pivotally connected to the housing 112 by a pin 152.

The off center latch 138 and the latch portions 140 and 142 are moved from a static position illustrated in FIG. 7 to a drive position illustrated in FIG. 8 by a solenoid 154 that is secured to the housing 112. The solenoid 154 includes an armature 156 that is pivotally coupled to the pin 144. The solenoid 154 is actuated by a switch 158 defined on the handle 116. Upon actuation of the switch 158, the solenoid armature 156 is moved upward moving the off center latch 138 to the drive position shown in FIG. 8.

In the static position (FIG. 7) the idler pivot 150 is in a position such that an idler wheel 160 rotatably secured to the pivot 150 by a pin 161 is in a position spaced from the driver 124. Upon energization of the solenoid 154 and movement of the off center latch 138 to the drive position (FIG. 8), the idler pivot 150 is moved to a position such that the idler wheel 160 engages the driver 124 forcing it against the flywheel 122. In this position, the beam spring 136 biases the toggle mechanism 138 in the direction toward the driver 124.

Accordingly, upon actuation of the solenoid 154 from the static to the drive position, the idler wheel 160 is biased against the driver 124 under the influence of the beam spring 136. In the driving position, the frictional material secured to the driver 124 engages the flywheel 122. The flywheel 122 is rotated in a direction illustrated by the arrow 162 such that upon engagement with the driver 124, the driver is moved through a driving stroke.

Upon completion of the drive stroke the solenoid switch 158 may be released extending the actuator 156 and moving the off center latch 138 to the static position. This, in turn, moves the idler wheel 160 out of engagement with the driver 124 thus releasing the engagement of the flywheel 122 with the driver 124. Once this is accomplished, a return spring 164 that is mounted within the housing 112 and coupled to the driver 124 returns the driver to its original position engaging an upper stop 166 whereupon the tool 110 is again in condition for another drive stroke.

Figure 9:
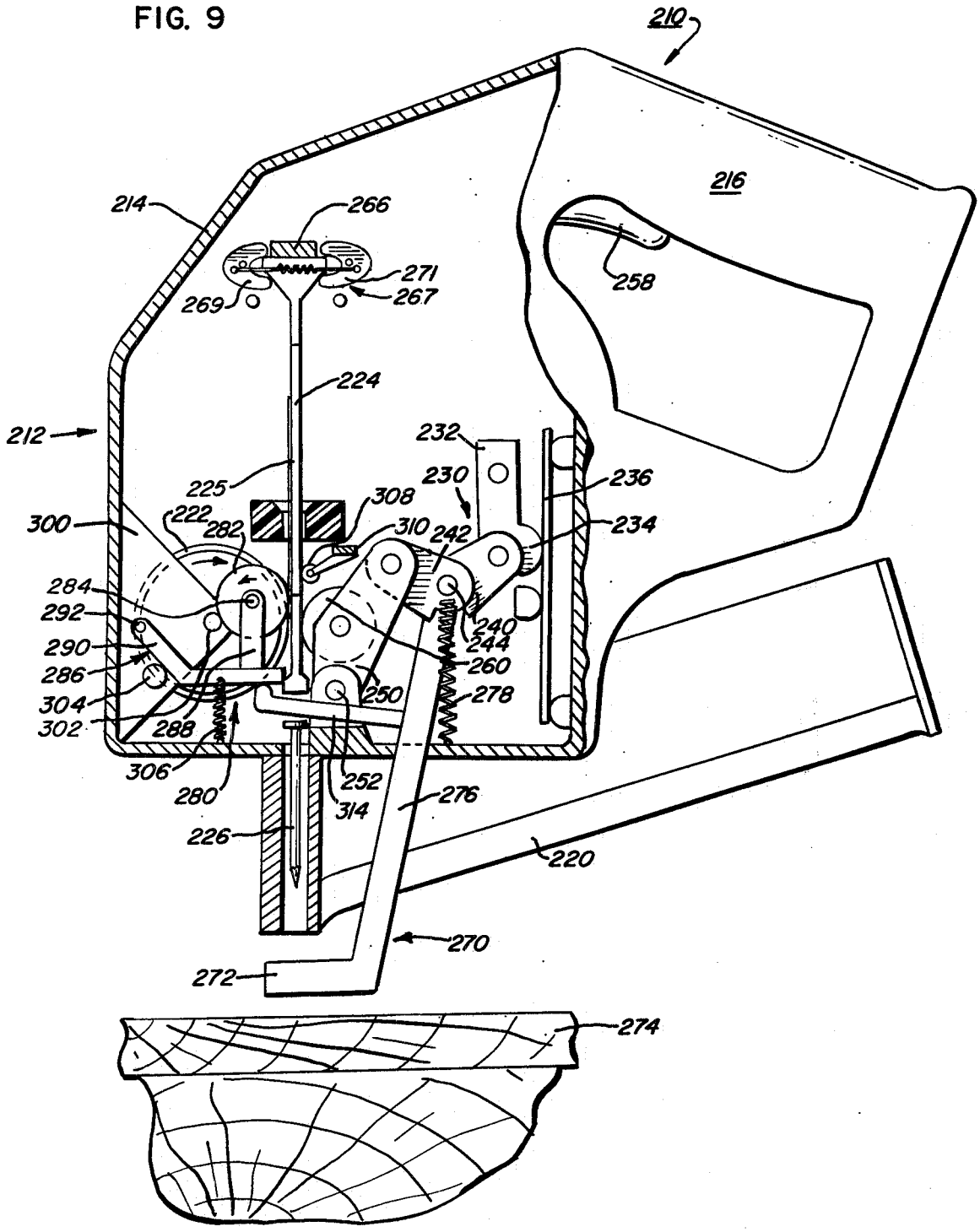
FIG. 9 is a partially cut-away view of another alternative embodiment of the tool including a driver return assembly in the return position.

Turning now to FIGS. 9–10, there is illustrated a further alternative embodiment 210 of an impact tool. The impact tool 210 differs from the previous embodiments in that it employs a novel and improved assembly for returning the driver 224 at the completion of a driving stroke. The tool 210 is similar in many respects to the embodiment 110 illustrated in the FIGS. 7–8.

More specifically, the tool 210 is defined by a housing 212 that includes a body 214 and a handle 216. Reciprocally mounted within the housing 212 is the driving ram 224 that is driven by the engagement of the flywheel 222 with the ram 224 upon the ram 224 being moved into engagement with the flywheel 222 by the idler wheel 260. Actuation of the idler wheel 260 is accomplished by the toggle mechanism 230 that includes the toggle levers 240 and 242. The toggle levers 240 and 242 are pivotally joined by a pin 244 that defines the knee of the toggle mechanism 230. The lever 240 is pivotally connected to an arm 232 that is pivotally secured to the housing 214. A ball portion or extension 234 of the arm 232 engages a beam spring 236 that tends to bias the toggle mechanism 230 in the direction of the ram 224.

The idler wheel 260 is rotatably coupled to an idler pivot 250 that is pivotally secured by a pin 252 to the housing 214.

Contrary to the embodiment illustrated in FIGS. 7 and 8, the idler wheel 260 is moved into engagement with the driver 224 by a workpiece engagement member generally designated by the reference numeral 270. The workpiece engagement member 270 includes a first extension 272 adapted to engage a workpiece such as a board 274. The workpiece engagement member 270 also includes a second member 276 extending from extension 272 and pivotally coupled to pin 244 of the toggle mechanism 230; and, more specifically, to the knee of the toggle levers 240 and 242. In the position of nonengagement (FIG. 9), a spring 278 that is coupled at one end to the pin 244 and the other end to the housing 214 biases the toggle mechanism 230 to an off center position. In this position, the idler wheel 260 is spaced from the driver 224.

To fire the tool 10, the motor switch 258 is actuated to energize the motor driving the flywheel 222. Subsequent to this step, the tool 210 is then moved onto the workpiece 274 whereupon the engagement portion 272 of the workpiece engagement member 270 engages the workpiece 274 and is pushed upwardly. This action moves the toggle mechanism 230 to the position illustrated in FIG. 10. In this position the idler wheel 260 is moved against the ram 224 causing the ram 224 to engage the flywheel 222. This engagement drives the ram 224 through a power stroke driving a fastener such as the nail 226 as supplied by the magazine 220 into the workpiece 274.

Once a fastener 226 has been driven into the workpiece 274, the tool 210 may be lifted away from the workpiece 274 whereupon the driver 224 will be returned to its static position in preparation for a subsequent power stroke. Upon removal of the tool 210 from the workpiece 274, spring 278 returns the toggle mechanism 230 to its static position as illustrated in FIG. 9. This action moves the idler wheel 260 away from the driver 224 allowing the driver 224 to move out of engagement with the flywheel 222. Return of the driver 224 is accomplished by a return assembly generally designated by the reference numeral 280. The return mechanism 280 includes an idler wheel 282 rotatably connected by a pin 284 to a support arm mechanism generally designated by the reference numeral 286.

The support arm mechanism 286 includes a first arm portion 288 to which the idler wheel 282 is pivotally connected. Also connected to the arm 288 is an angle arm 290 that at one end is pivotally connected by a pin 292 to the support bracket 300 to which the flywheel 222 is rotatably secured by a flywheel shaft 302. In the static position of the tool 210 (FIG. 9), the support arm assembly 286 is biased to a position wherein the angle arm 290 engages a stop 304 defined on the support bracket 300. The support arm assembly 286 is biased into this position in part by a spring 306 that at one end is coupled to the angle arm 290 and at the other end is coupled to the housing 214.

In the static position, the idler wheel 282 engages the flywheel axle 302 and is rotated by the axle 302 in a direction opposite that of the flywheel 222. The ram 224 includes an extension 225 (FIG. 11) that serves as the surface engaged by the wheel 282 when the ram 224 is being returned to the static position of the tool 210. In the static position of the tool (FIG. 9), the wheel 282 (shown in phantom in FIG. 11) is slightly below the extension 225, and although the wheel 282 is rotating, it does not engage the extension 225 or the ram 224. After firing the tool 210 and lifting it from the workpiece 274, the wheel 282 (shown in solid lines in FIG. 11) is positioned at the upper end and engages the extension 225. Accordingly, through this engagement, the ram 224 is returned to its static position.

More specifically, once the tool is fired and is lifted from the workpiece 274, the wheel 282 engages the shaft 302 and the ram 224 at the extension 225 (solid lines in FIG. 11). The ram 224 is clamped between the wheel 282 and an idler wheel 308 that is rotatably secured to the housing 214 by a bracket 310. In this position, the rotating idler wheel 282 will propel the driver 224 upwardly to engagement with the upper stop 266 and a driver clamping device 267 whereupon the end of the driver 224 is held in a position with the extension 225 slightly above the wheel 282 (phantom lines in FIG. 11). The clamping device 267 includes a pair of spring actuated clamps 269 and 271 that are adapted to clamp the end of the driver 224 upon engagement and hold it in an elevated position (FIG. 9) until the tool 210 is again fired.

To fire the tool 210, the return assembly 280 must be moved out of engagement with the driver 224. This is accomplished by the workpiece engagement member 270. The member 270 includes an arm 314 that in the static position (FIG. 9) extends to a position directly below the angle arm 290. As the workpiece engagement member 270 is moved upwardly upon engagement with the workpiece 274, the arm 314 engages the angle arm 290 pivoting the support assembly 286 about the pin 292 to a position wherein the idler wheel 282 is rotated out of engagement with the flywheel axle 302 and the drive ram 224. Once the idler wheel 282 is moved out of its static position, the continued movement of the workpiece engagement member 270 moves the idler wheel 260 into engagement with the driver 224 thereby initiating the drive stroke of the driver 224.

While the invention has been described with reference to details of the illustrated embodiment, it should be understood that such details are not intended to limit the scope of the invention as defined in the following claims.

What is claimed and desired to be secured by Letters Patent of the United States is:

1. An impact tool for applying a driving force to a fastener for driving said fastener into a workpiece, said tool comprising:

a tool housing;

a driver reciprocally mounted in said housing for driving said fastener;

at least one high speed, rotational energy device rotatably mounted in said housing and spaced from said driver;

means for rotating said energy device;

means for transferring said rotational energy of said energy device to said driver, said transferring means including a toggle mounted in said housing and movable from a first nonenergy transferring position to a second position coupling said energy device with said driver for transferring said energy to said driver thereby moving said driver into driving engagement with said fastener; and means for moving said toggle into said first and second positions.

2. The tool claimed in claim 1 wherein said rotational energy device comprises a flywheel and said tool further comprises a motor for rotating said flywheel at a high speed.

3. The tool claimed in claim 1 wherein said toggle moving means comprises an electrically actuated solenoid mounted on said tool adjacent said toggle.

4. The tool claimed in claim 1 wherein said energy transferring means further includes a clutch member secured to said toggle at a position adjacent said energy device, said clutch member movable by said toggle into engagement with said energy device upon movement of said toggle into said second position, said clutch member being moved by said energy device upon engagement to drive said driver into driving engagement with said fastener.

5. The tool claimed in claim 4 wherein said toggle moving means includes a bumper member mounted in said housing for moving said clutch member out of engagement with said energy device after driving of said fastener.

6. The tool claimed in claim 1 further comprising means defined in said housing for returning said driver after driving of said fastener.

7. The tool claimed in claim 1 wherein said energy transferring means further includes a wheel rotatably secured to said toggle adjacent said driver, said driver being positioned between said energy device and said wheel, said wheel being movable by said toggle to move said driver into engagement with said energy device upon movement of said toggle into said second position.

8. The tool claimed in claim 7 further including means connected to said toggle for biasing said wheel away said energy device.

9. A tool for driving fasteners comprising:
a housing;
a fastener driving ram reciprocally mounted in said housing;
a flywheel rotatably mounted in said housing adjacent said ram;
means for rotating said flywheel at a high angular velocity;
means for engaging said ram with said flywheel to drive said ram into driving engagement with a fastener, said engaging means comprising a linkage assembly, said linkage assembly including a toggle movable from a first, static position to a second, ram engaging position; and
means for moving said toggle from one of said positions to the other of said positions.

10. The tool claimed in claim 9 wherein said ram includes frictional material secured thereon and engageable by said flywheel during the driving stroke of said ram.

11. The tool claimed in claim 9 wherein said linkage assembly further includes a rotary member coupled to said assembly, said rotary member being movable by said toggle from a first static position to a second position wherein said rotary member engages said ram and moves said ram into engagement with said flywheel.

12. The tool claimed in claim 11 said toggle including first and second ends and a knee, said linkage assembly further including a first lever having first and second ends, said first end of said first lever being pivotally coupled to said first end of said toggle, said second end of said first lever being pivotally coupled to said housing, said rotary member being rotatably coupled to said first lever.

13. The tool claimed in claim 12 said linkage assembly further including a second lever including first and second ends, said first end of said second lever being pivotally coupled to said housing, said second end of said second lever being pivotally coupled to said second end of said toggle.

14. The tool claimed in claim 13 further comprising biasing means connected to said knee for biasing said linkage assembly and said wheel away from said ram.

15. The tool claimed in claim 12 wherein said toggle moving means comprises a solenoid coupled to said knee of said toggle.

16. A tool for driving fasteners comprising:
a housing;
a ram reciprocally mounted in said housing;
a motor mounted in said housing;
a flywheel rotatably mounted in said housing and coupled to said motor for rotation thereby;
linkage means for mechanically coupling said flywheel to said ram;
means for moving said linkage means from a first, static position to a second, flywheel coupling position; and
clutch means coupled to said linkage means for engaging said flywheel upon movement of said linkage means to said second position thereby moving said linkage means and said ram through a drive stroke.

17. The tool claimed in claim 16 further comprising:
bumper means mounted in said housing for engaging said clutch means at the end of said drive stroke to move said clutch means out of engagement with said flywheel.

18. The tool claimed in 17 further comprising:
return means connected to said linkage means for returning said ram and said linkage means to said first static position.

19. The tool claimed in claim 16 wherein said linkage means includes a toggle including a first and second end and a knee, said first end of said toggle being coupled to said driver.

20. The tool claimed in claim 19 wherein said linkage moving means comprises a solenoid actuable to move said knee.

21. An impact tool for driving a fastener into a workpiece comprising:
a tool housing;
a driving ram reciprocally mounted in said housing for driving said fastener;
a rotational energy device rotatably mounted in said housing and spaced from said ram;
means for rotating said energy device;
control means for coupling said ram and said energy device for driving said ram from a ready position to a fastener driving position; and
ram return means for returning said ram to said ready position, said return means including a first ram engagement member pivotally and rotatably mounted in said housing, said first ram engagement member movable from a first position in engagement with said ram and said energy device to a second position out of engagement with said energy device and said ram, said control means pivoting said first ram engagement member to said second position upon coupling of said energy device with said ram, said control means pivoting said first ram engagement member to said first position upon and removal of said tool from said workpiece.

22. The tool claimed in claim 21 wherein said control means includes a first lever including first and second ends, said first end being pivotally secured to said housing, and a workpiece engagement member including first and second ends, said first end of said workpiece engagement member adapted to engage said workpiece, said second end of said workpiece engagement member being pivotally coupled to said first lever, said workpiece engagement member movable from a first to a second position upon engagement of said first end of said workpiece engagement member with said workpiece, said first lever being moved by said workpiece engagement member from a first to a second position to couple said ram and said energy device upon movement of said workpiece engagement member to said second position.

23. The tool claimed in claim 22 wherein said ram return means includes a second lever pivotally secured to said housing, said first ram engagement member being rotatably mounted on said second lever, said second lever being positioned within said housing adjacent a portion of said workpiece engagement member and engaged thereby as said ram engagement member moves to said second position.

24. The tool claimed in claim 22 further comprising a wheel being rotatably coupled to said first lever for engaging said ram.

25. The tool claimed in claim 21 further including a second, stationary ram engagement member, said ram engaging said second ram engagement member upon said first ram engagement member being moved to said second position.

26. The tool claimed in claim 21 wherein said control means includes a toggle pivotally mounted in said housing and movable from a first, static position to a second position coupling said ram to said energy device.

27. The tool claimed in claim 26 wherein said control means further includes a rotary member coupled to said toggle, said rotary member movable to move said ram into engagement with said energy device upon movement of said toggle to said second position.

* * * * *